US007367747B2

(12) United States Patent
Maffett et al.

(10) Patent No.: US 7,367,747 B2
(45) Date of Patent: May 6, 2008

(54) ADJUSTABLE AND EXTENDING TRANSPORT CRADLE FOR WATERCRAFT

(75) Inventors: William C. Maffett, Cookeville, TN (US); Brian D. Maffett, Cookeville, TN (US)

(73) Assignee: Maff-Stack, LLC, Cookeville, TN (US)

( * ) Notice: Subject to any disclaimer, the term of this patent is extended or adjusted under 35 U.S.C. 154(b) by 305 days.

(21) Appl. No.: 11/338,865

(22) Filed: Jan. 24, 2006

(65) Prior Publication Data

US 2006/0177271 A1 Aug. 10, 2006

Related U.S. Application Data

(63) Continuation-in-part of application No. 10/899,384, filed on Jul. 26, 2004, now Pat. No. 7,112,007.

(60) Provisional application No. 60/646,365, filed on Jan. 24, 2005, provisional application No. 60/490,066, filed on Jul. 25, 2003.

(51) Int. Cl.
*B63C 15/00* (2006.01)

(52) U.S. Cl. ..... 405/1; 405/3; 414/282

(58) Field of Classification Search ..... 405/1, 405/3; 414/281, 282
See application file for complete search history.

(56) References Cited

U.S. PATENT DOCUMENTS

| | | | | |
|---|---|---|---|---|
| 1,515,435 A | * | 11/1924 | Glover | 405/7 |
| 3,029,913 A | | 4/1962 | Liesenfeld | 189/37 |
| 3,341,164 A | * | 9/1967 | Ewing, Jr. | 405/7 |
| 3,385,458 A | | 5/1968 | Gresham | 214/16.4 |
| 3,788,942 A | | 1/1974 | Dane, Jr. | 214/16.4 |
| 3,802,580 A | | 4/1974 | Castaldi | 214/16.4 |
| 4,070,979 A | | 1/1978 | Otis et al. | 114/263 |
| 4,190,013 A | | 2/1980 | Otis et al. | 114/263 |
| 4,227,828 A | * | 10/1980 | Ivanov et al. | 405/7 |
| 4,268,207 A | | 5/1981 | Pipes | 414/277 |
| 4,372,724 A | | 2/1983 | Stolzer | 414/281 |
| 4,488,847 A | | 12/1984 | Stolzer | 414/222 |
| 4,502,406 A | | 3/1985 | Merry | 114/204 |

(Continued)

FOREIGN PATENT DOCUMENTS

FR 2552411 3/1985

(Continued)

OTHER PUBLICATIONS

Brochure "Marinas and Small Craft Harbore," authored by Tobiasson and Kollmeyer, published by Van Nostrand Reinhold, NY.

*Primary Examiner*—Frederick L. Lagman
(74) *Attorney, Agent, or Firm*—Waddey & Patterson; Phillip E. Walker

(57) ABSTRACT

A cradle assembly for moving and positioning a watercraft with respect to a support module. The cradle assembly comprises a plurality of horizontally varying cradle beams, a cradle wall extending upward from the cradle beams and a transportation track traversing the cradle beams. A transportation rail is slideably positioned on the transportation track to engage the bottom of the water craft as the cradle assembly moves the watercraft with respect to the support module. A positioning system is operatively connected to the transportation rail to extend a substantial portion of the transportation rail within the support module to place the watercraft in and retrieve it from the support module.

20 Claims, 5 Drawing Sheets

U.S. PATENT DOCUMENTS

| | | | | |
|---|---|---|---|---|
| 4,640,214 | A | 2/1987 | Bruns | 114/263 |
| 4,726,316 | A | 2/1988 | Bruns | 114/263 |
| 4,787,804 | A | 11/1988 | Edenas | 414/281 |
| 4,797,055 | A | 1/1989 | Tworoger et al. | 414/283 |
| 4,953,488 | A | 9/1990 | Heidtmann | 114/44 |
| 4,971,505 | A | 11/1990 | Sawyer | 414/232 |
| 4,979,869 | A | 12/1990 | Mullin, Jr. | 414/786 |
| 5,011,357 | A | 4/1991 | Studler | 414/253 |
| 5,018,926 | A | 5/1991 | Sternad | 414/253 |
| 5,238,348 | A | 8/1993 | Reimer | 414/254 |
| 5,487,636 | A | 1/1996 | Mkrtchyan | 414/286 |
| 5,882,170 | A | 3/1999 | Walton | 414/462 |
| 6,007,288 | A | 12/1999 | Maffett et al. | 414/281 |
| 6,099,014 | A | 8/2000 | McLaughlin | 280/414.1 |
| 6,162,003 | A * | 12/2000 | Gruner | 414/281 |
| 6,189,909 | B1 | 2/2001 | Danchuk | 280/414.1 |
| 6,263,820 | B1 | 7/2001 | Crifase et al. | 114/219 |
| 6,327,990 | B1 | 12/2001 | Crifase et al. | 114/219 |
| 6,446,997 | B1 | 9/2002 | Bergman et al. | 280/414.3 |
| 6,490,987 | B1 | 12/2002 | Crifase et al. | 114/219 |
| 6,520,728 | B1 | 2/2003 | Schwitters | 414/467 |
| 6,612,602 | B1 | 9/2003 | MacKarvich | 280/414.1 |
| 6,644,231 | B2 | 11/2003 | Crifase et al. | 114/219 |
| 6,719,317 | B1 | 4/2004 | Grovender et al. | 280/414.1 |
| 6,752,099 | B1 | 6/2004 | Crifase et al. | 114/219 |
| 7,112,007 | B2 * | 9/2006 | Maffett et al. | 405/3 |
| 2002/0176767 | A1 * | 11/2002 | Gisselberg | 414/261 |

FOREIGN PATENT DOCUMENTS

| | | | |
|---|---|---|---|
| GB | 882343 | 11/1961 | 414/254 |
| JP | 2-048311 | 2/1990 | |
| JP | 2-088853 | 3/1990 | 414/254 |
| JP | 2-183055 | 7/1990 | |
| JP | 2-241891 | 9/1990 | 414/254 |
| JP | 3-119270 | 5/1991 | 414/254 |
| JP | 05069886 A * | 3/1993 | |
| JP | 05213269 A * | 8/1993 | |
| JP | 05262286 A * | 10/1993 | |

* cited by examiner

ADJUSTABLE AND EXTENDING TRANSPORT CRADLE FOR WATERCRAFT

CROSS-REFERENCES TO RELATED APPLICATIONS

This application is a Non-Provisional Utility application which claims benefit of co-pending U.S. Patent Application Ser. No. 60/646,365 filed Jan. 24, 2005, entitled "Water Storage System For Watercraft of Varying Dimensions", and a continuation-in-part application which claims benefit of U.S. patent application Ser. No. 10/899,384 filed Jul. 26, 2004, now U.S. Pat. No. 7,112,007 entitled "Improved Cradle For A Watercraft Storage System" which claims benefit of U.S. Patent Application Ser. No. 60/490,066 filed Jul. 25, 2003, entitled "Improved Cradle For A Watercraft Storage System", all of which are hereby incorporated by reference in their entireties.

All patents, patent applications, and publications described or discussed herein are hereby incorporated by reference in their entireties.

BACKGROUND OF THE INVENTION

The present invention relates generally to cradle assemblies for moving items into and out of storage, especially the movement of items with irregular bottoms, or lower regions, into which a cradle assembly engages. More particularly, but not by way of limitation, the present invention relates to an improvement to an adjustable cradle assembly for the dry storage of watercraft.

The current improvements to such cradle assemblies enhance the engagement between the cradle assembly and the bottom, or hull, of the watercraft. Additionally, the current improvements facilitate the transportation of multiple watercrafts by a single cradle. The current improvements also facilitate reduction in expensive construction features in the dry storage facility. The improvements include an adjustable width to the cradle and a safe extension of the watercraft into a dry storage bay from the cradle.

It will be appreciated by those skilled in the art that watercraft transportation devices have existed for many years. However, most of these transportation devices are in the form of trailers or land anchored platforms that use the watercraft's power and/or a crank to pull the watercraft out of the water by its bow. For example U.S. Pat. Nos. 6,612,602, 6,099,014, 5,882,170, 6,520,728, 6,189,909, 6,446,997, 6,719,317, 6,752,099, 6,644,231, 6,490,987, 6,327,990, and 6,263,820, all disclose such transportation devices.

Additionally, the dry storage of watercraft is becoming increasingly popular over the years. This dry dock storage includes a stacked or vertical arrangement of watercraft storage slips, or bays. The watercraft is lifted from the water's surface and placed in the stacked arrangements. For example, U.S. Pat. No. 6,007,288 discloses one such watercraft storage system. However, the conventional art has a drawback based on the wide variety of watercraft that is currently popular and available. Currently, most watercraft at a given dray storage facility vary in over all length, depth and width between individual watercraft. As such, any lifting apparatus used to place the watercraft from the water surface into the storage system should be able to handle this variety. However, currently the conventional lifting apparatus that move the watercraft from the water surface to the dry storage area lack the capability and flexibility to vary their dimensions in order to adapt to the variance in the watercraft.

The conventional dry storage facilities for watercraft also typically use long cantilever beams extending from a wall, or a vertical support structure, within the dry storage facility. These cantilever beams can be expensive to manufacture and assemble within the storage facility but are typically required due to the variance in length of the watercraft and the required interaction between the individual storage bay and the transport cradle that positions the watercraft in the individual bays.

As such, what is lacking in the art is a cradle assembly that can vary its dimensions to substantially adapt to the variance in watercraft sizes in order to transport that watercraft to a storage area. Also, the art lacking a safe adaptation to cradle assemblies that interact with storage bays to position the watercraft in the bays while reducing the costs and assembly times associated with the storage facility.

BRIEF SUMMARY OF THE INVENTION

Disclosed herein is a cradle assembly for moving and positioning a watercraft with respect to a support module. The support module is in a watercraft storage assembly and the watercraft includes a bottom and a width. The cradle assembly comprises a plurality of cradle beams, a cradle wall extending upward from one of the cradle beams and a transportation track traversing the cradle beams. A transportation rail is slideably positioned on the transportation track to engage the bottom of the water craft as the cradle assembly moves the watercraft with respect to the support module. A positioning system is operatively connected to the transportation rail to extend a substantial portion of the transportation rail within the support module to place the watercraft in and retrieve it from the support module.

The cradle assembly can include a padded support attached to the transportional rail opposite the transportational track wherein the padded support engages the bottom, or hull, of the watercraft.

A cradle clamp can be positioned on the cradle wall to selectively engage a post of the support module during movement of the watercraft relative to the support module and restrict movement of the cradle assembly relative to the support module. The cradle clamp can be actuated by the movement of the transportation rail such that the cradle clamp will engage the support module after activation of the transportation rail. The cradle clamp can also include friction reducing devices that are positioned to engage the support module and that allow vertical movement of the cradle assembly relative to the support module while restricting horizontal movement of the cradle assembly relative to the support module.

A securing bracket can be fixed to the transportation rail and slideably engage the transportation track. The securing brackets position to restrict vertical movement of the transportation rail with respect to the transportation track.

The cradle beams can be horizontally adjusted, or telescoping, in nature. Various sections of the cradle beam can extend horizontally from other associated sections of the cradle beam. This movement can be controlled by a cradle beam adjustment system. The cradle beam adjustment system can be positioned to control this horizontal adjustment and can selectively space the transportation tracks located on the cradle beams. For example, the cradle beam adjustment system can space the transportation tracks a width that is less than the width of the water craft.

As such it is an object of the present invention to provide a cradle assembly from moving and positioning items with respect to a support module and a support assembly or facility.

Another object of the present invention is to provide an adjustable and extending cradle assembly for watercraft.

Still another object of the present invention is to provide a cradle assembly for moving and positioning watercraft wherein the cradle assembly can vary its dimensions.

Yet another object of the present invention is to provide a cradle assembly having expandable cradle beams.

Still another object of the present invention is to provide a cradle assembly that reduces the need for cantilever beams in a dry storage facility.

Another object of the present invention is to provide a cradle assembly that has extendable rails to position a watercraft in a storage bay.

Yet still another object of the present invention is to provide a cradle assembly that selectively engages the storage bay to restrict horizontal movement of the cradle assembly during placement of the watercraft in a storage bay.

Other and further objects features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 4 shows an example of an interaction between the cradle clamp and transportation rail to secure the cradle clamp to the support module.

DETAILED DESCRIPTION OF THE INVENTION

Figure 1:
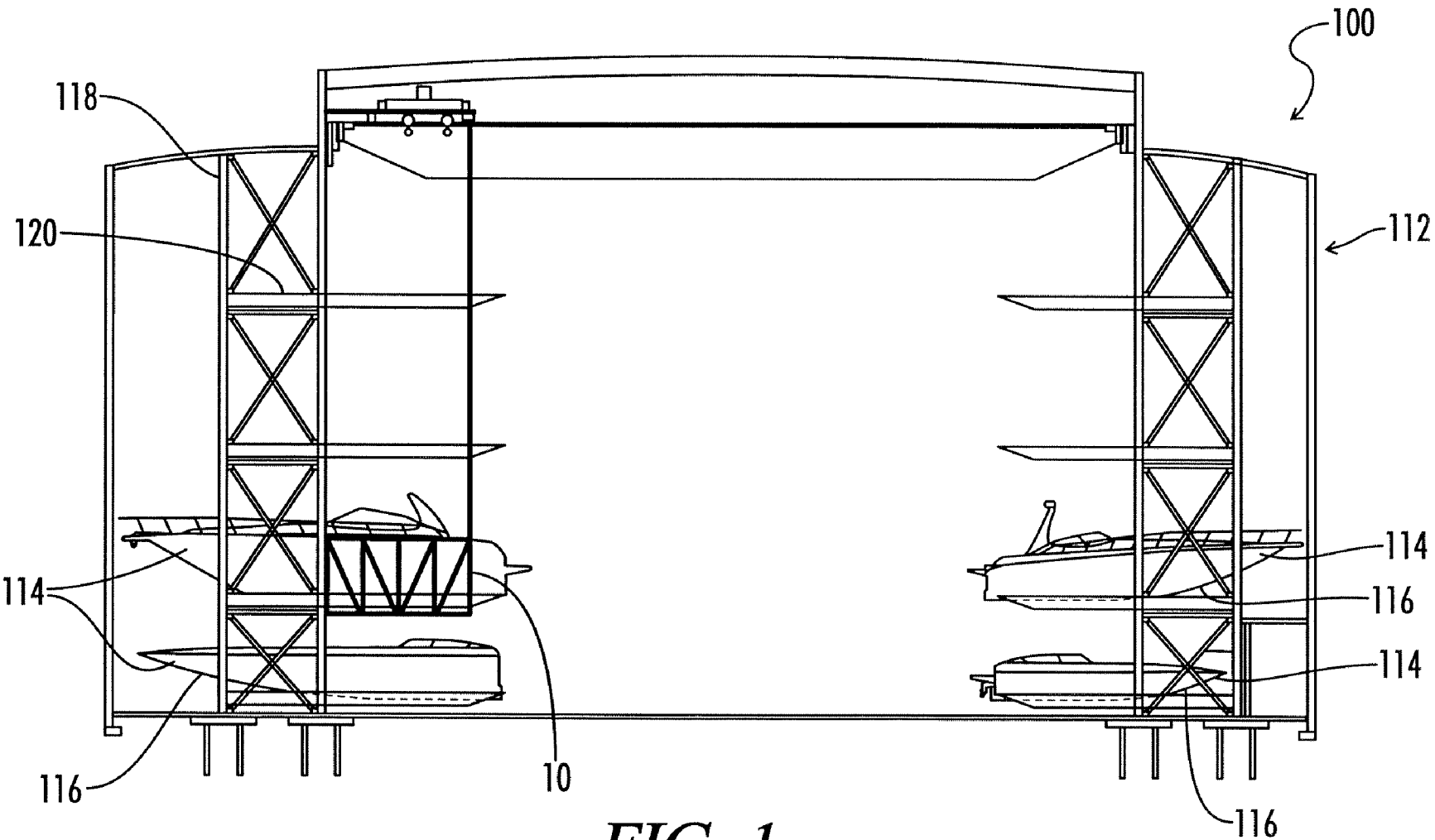
FIG. 1 (PRIOR ART)
FIG. 1 is an end view of a prior art watercraft storage assembly shown with various support modules and watercraft types positioned therein.
Figure 2:
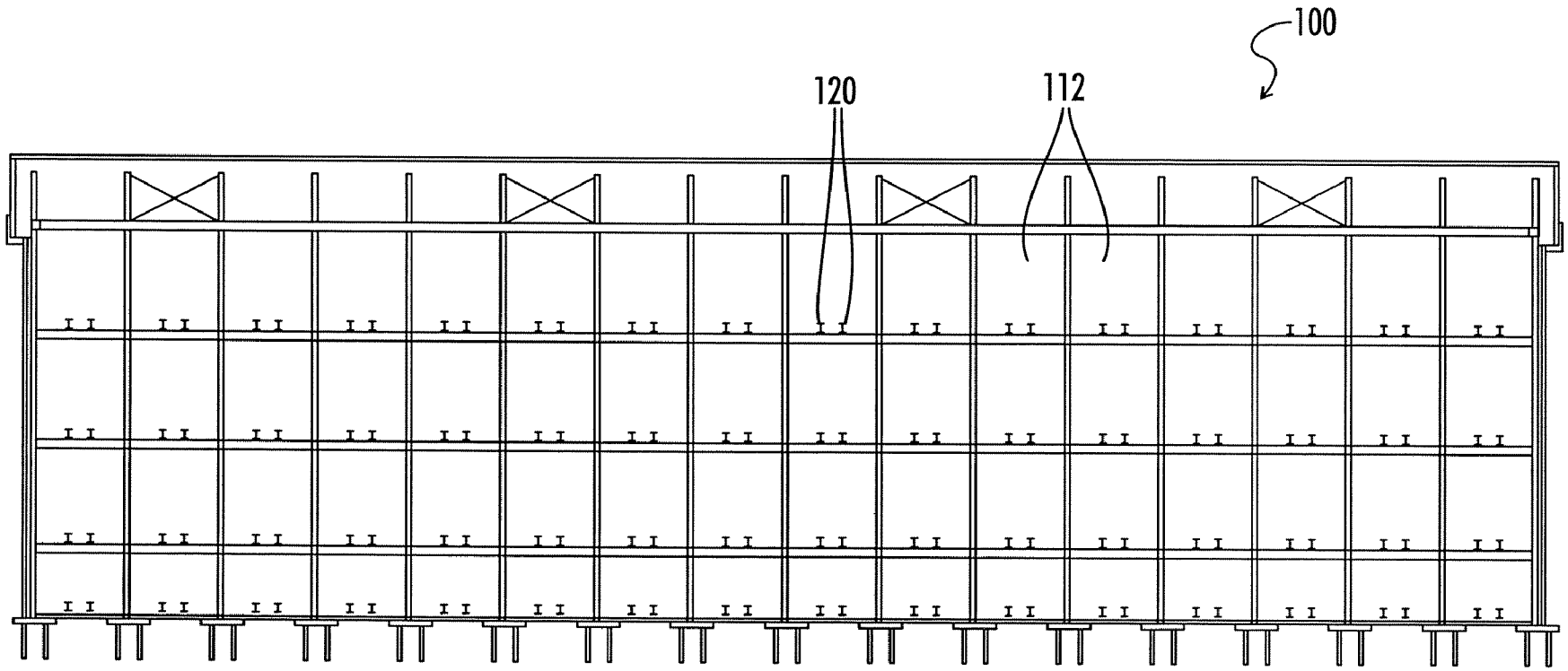
FIG. 2 (PRIOR ART)
FIG. 2 is a side sectional view of a prior art storage assembly with various support modules stacked therein.

Referring now to FIGS. 1-2, examples of a prior art storage facility are shown and designated by the numeral 100. The storage assembly 100 is for the storage of items 114, such as watercraft 114, wherein the cradle assembly 10 moves and positions the watercraft 114 with respect to individual support modules 112. The watercraft 114 includes a bottom 116 having undulations and a width of varying sizes. The storage assembly 100 can include a support wall 118 and at least two support modules 112 mounted and stacked in a relationship on a support wall 118 such that each support module 112 can store a watercraft 114. These prior art storage facilities 100 use cantilever beams 120, of which the current invention is designed to reduce, or eliminate, the need for such beams.

Referring now to FIGS. 3-6, the cradle assembly 10 includes cradle beams 12 spaced along the length of the cradle assembly 10. Cradle walls 14 extend from the cradle beams 12 in a preferably vertical manner while transportation tracks 16 traverse the cradle beams 12. A transportation rail 18 is slideably positioned on the transportation track 16 to engage the bottom 116 of the watercraft 114 as the cradle assembly 10 moves the watercraft 114 with respect to the support module 112. The slideable connection can be facilitated by friction reducing devices 17, positioned on the transportation track 16 to support the transportation rail 18. The friction reducing devices 34 can include those items known in the art to allow one surface to move transverse to another, such as rollers, castors, wheels, and the like.

A positioning system 20 is operatively connected to the transportation rail 18 to extend a substantial portion of the transportation rail 18 into the support module 112. The position system 20 can extend a substantially the entire transportation rail 18 into the support module 112 to position the watercraft 114 in the support module 112.

Figure 3:
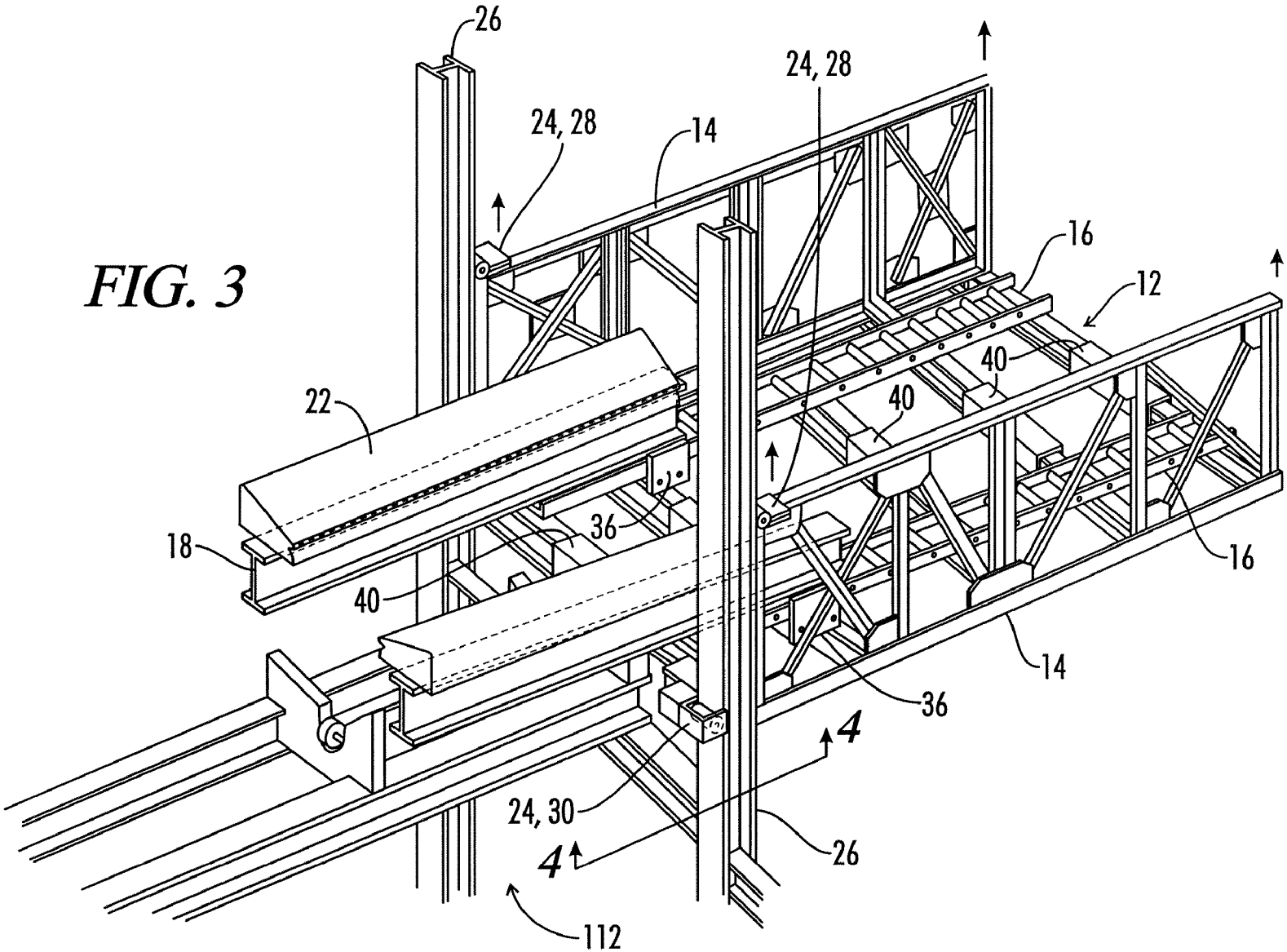
FIG. 3 is a perspective view of a cradle assembly interacting with a support module in accordance with the current disclosure.

A padded support 22 is positioned on the transportation rail 18, which can be various beams known in the art to support the weight of a watercraft, such as I-beams, rails and the like. The padded support can be space rollers or other friction reducing members that favor certain types of boats, such as pontoon boats and catamarans. The padded supports 22 can also be foam padding or a bladder having captured air, wherein the supports 22 are laid out parallel to the transportation rails 18 as shown in FIG. 3.

A cradle clamp 24 is positioned on the cradle wall 14 to selectively engage a stanchion 26 of the support module 112. The cradle clamp 24 restricts horizontal movement of the cradle assembly 10 with respect to the support module 112 during movement of the watercraft 114 relative to the support module 112. The cradle clamp 24 can include top and bottom braces 28 and 30 and an actuating arm 32. The actuating arm 32 is positioned to engage the transportation rail 18 in order to engage the cradle clamp 24 to the stanchion 26 of the support module 112 after activation of the transportation rail 18.

In a mechanical example, horizontal movement of the transportation rail 18 can cause a cam 33 to strike the actuating arm 32 to press the bottom brace 30 into engagement with the stanchion 26. Alternately, sensors and automation can be used to activate the bottom brace 30 to engage the stanchion 26 concurrently with the movement of the transportation rail 18. The bottom brace 30 is preferably pivotably attached to the cradle wall 14 proximate to one of the cradle beams 12 while the top brace 28 is positioned on the cradle wall 14 opposite the attachment of the bottom brace 30. This positioning facilitates a proper restriction of horizontal movement of the cradle assembly 10 relative to the support module 112.

Figure 4:
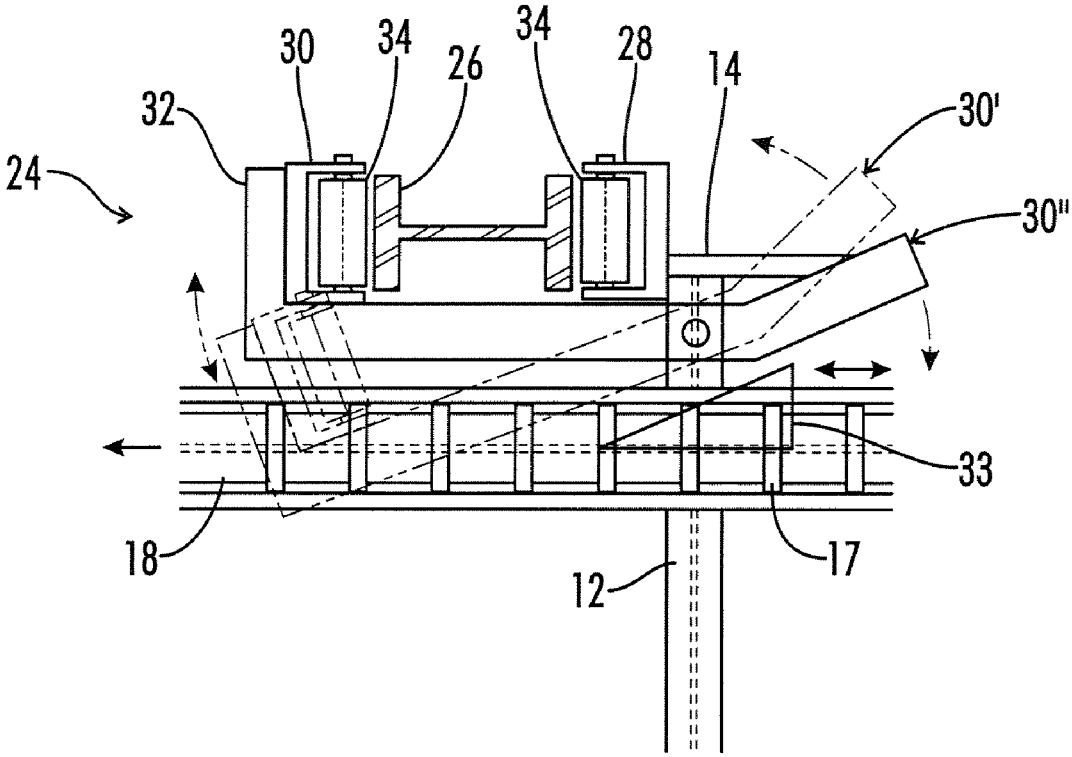
FIG. 4 is a partial cross-sectional view taken at 4-4 in FIG. 3.

A mechanical example of the interaction between the actuating arm 32, bottom brace 30, and stanchion 26 of the support module 112 is shown in FIG. 4. As the transportation rail 18 moves along the transportation tracks 16, the actuating arm 32 is activated by the cam 33 such that the bottom brace 30 is moved from position 30' to position 30", as shown as phantom lines and solid lines, respectively in FIG. 4. The actuating arm 32 and cam 33 can be designed such that reverse movement of the transportation rail 18 can reactivate the bottom brace 30 to disengage the bottom brace 30 from the stanchion 26.

The top and bottom braces 28 and 30 can also include friction reducing devices 34, such as rollers, castors, wheels, and the like known in the art to allow one surface to move transverse to another. These friction reducing devices 34 allow vertical movement of the cradle assembly 10 relative to the support module 112 while facilitating the restricted horizontal movement of the cradle assembly 10 relative to the support module 112.

The positioning system 20 can be numerous positioning systems known in the art. For example, the position system 20 can be motor or engine driven, as indicated by 15 in FIG. 6. The positioning system 20 can include a drive sprocket 19 and chain 21 positioned under the transportation rail. Other positioning systems can include hydraulic pistons, hydraulic motors, pneumatics, and other drive systems known in the art. Other examples of positioning systems can be threaded systems known to linearly displace two objects relative to each other.

The transportation rail 18 can also include a securing bracket 36 fixed to the transportation rail 18 and slideably engaging the transportation rack 16. This securing bracket 36 restricts vertical movement of the transportational rail 18 relative to the transportational tracks 16 during placement of the watercraft 114 in the support module 112. Additional securing brackets 36 can be employed on opposite ends of the transportation rail 118 to facilitate loading and unloading on both ends of the cradle assembly 10.

In one embodiment, the cradle beams 12 are horizontally adjustable. The cradle beams 12 include first and second sections 38 and 40, which can be described as left and right sides 38 and 40, and a middle section 42. The first and second sections 38 and 40 can extend from the middle section 42, either from within the middle section 42 or around the middle section 42, as desired.

Figure 5:
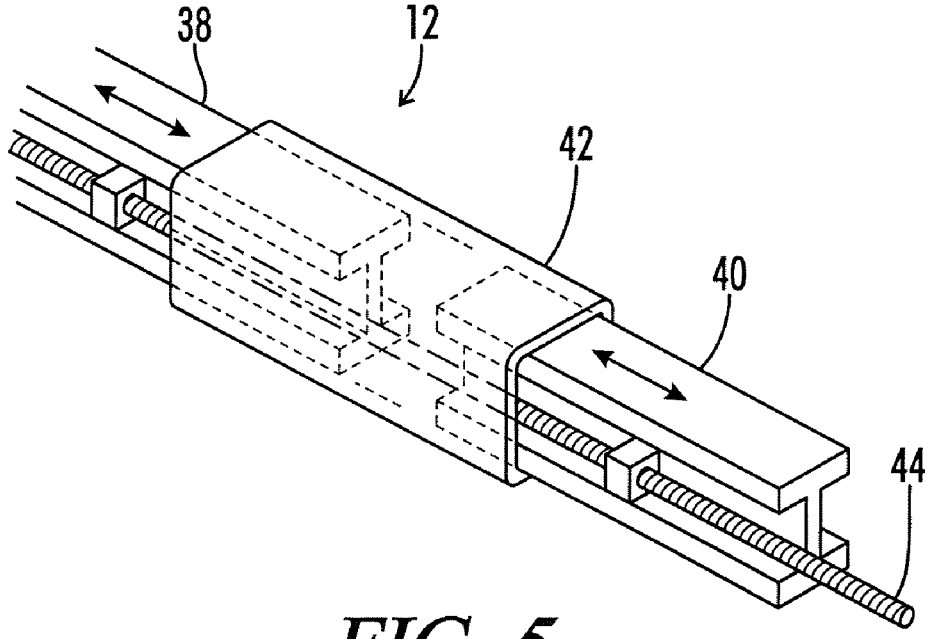
FIG. 5 shows a partial detail view of an example of a horizontally expandable cradle beams.
Figure 6:
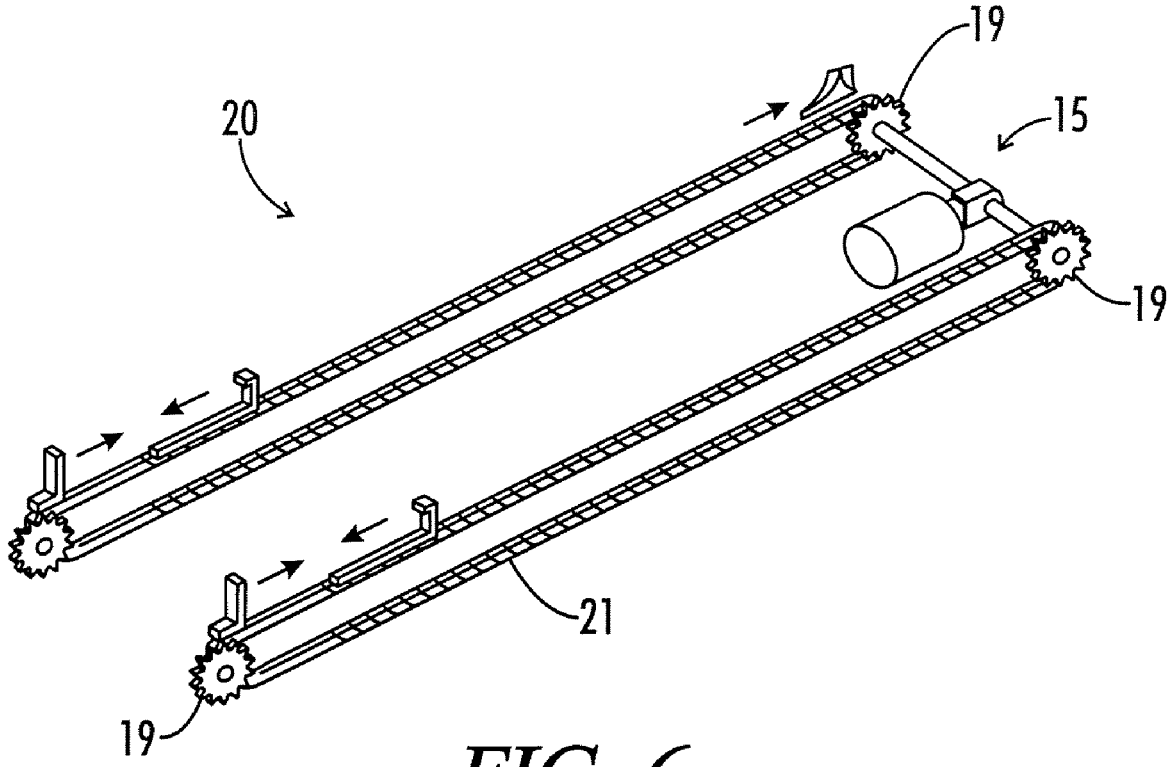
FIG. 6 shows an example of a positioning system used in accordance with the current disclosure.

A cradle beam adjustment system 44 is positioned to control the horizontal movement of the cradle beams 12. The adjustment system 44 can be positioned along the length of the cradle beams 12 and can selectively space the transportation tracks 16 and of the associated transportation rails 18 a desired width to correspond to the width of the watercraft 114 in order to support the watercraft 114. FIG. 5 shows an example of the horizontally extendable cradle beams 12 and an associated cradle beam adjustment system 44.

Thus, although there have been described particular embodiments of the present invention of a new and useful "Adjustable and Extending Transport Cradle for Watercraft", it is not intended that such references be construed as limitations upon the scope of this invention except as set forth in the following claims.

What is claimed is:

1. A cradle assembly for moving and positioning a watercraft with respect to a support module in a watercraft storage assembly, the watercraft including a bottom, the cradle assembly comprising a plurality of cradle beams;

at least one cradle wall vertically extending upward from one of the cradle beams;

at least one transportation track traversing the cradle beams;

a transportation rail slidably positioned on the transportation track to engage the bottom of the watercraft as the cradle assembly moves the watercraft with respect to the support module; and a positioning system operatively connected to the transportation rail to extend a substantial portion of the transportation rail within the support module.

2. The cradle assembly of claim 1, further including a padded support operatively attached to the transportation rail opposite the transportation track.

3. The cradle assembly of claim 1, further including a cradle clamp positioned on the cradle wall to selectively engage the support module during movement of the watercraft relative to the support module and restrict horizontal movement of the cradle assembly relative to the support module.

4. The cradle assembly of claim 3, the cradle clamp further including an actuating arm positioned to engage the transportation rail to engage the cradle clamp to the support module after activation of the transportation rail.

5. The cradle assembly of claim 3, wherein the cradle clamp includes:

a bottom brace pivotally attached to the cradle assembly and positioned proximate to one of the cradle beams; and a top brace positioned on the cradle wall opposite the cradle beam.

6. The cradle assembly of claim 5, wherein the top and bottom braces each include at least one friction reducing device positioned to engage the support module and allow vertical movement of the cradle assembly relative to the support module.

7. The cradle assembly of claim 1, wherein the positioning system includes a drive sprocket and chain positioned under the transportation rail.

8. The cradle assembly of claim 1, the transportation rail further including at least one securing bracket fixed to the transportation rail and slidably engaging the transportation track, the securing bracket restricting vertical movement of the transportation rail with respect to the transportation track.

9. The cradle assembly of claim 1, wherein the cradle beams are horizontally adjustable.

10. The cradle assembly of claim 9, each cradle beam including first second and middle sections, wherein the first and second sections horizontally extend with respect to the middle section.

11. The cradle assembly of claim 9, wherein:

further including:

a cradle beam adjustment system positioned to control the horizontal adjustment of the cradle beams; and a first and second transportation track;

the watercraft includes a width, and the cradle beam adjustment system selectively spaces the transportation tracks from each other a width less than the width of the watercraft.

12. A cradle assembly for moving and positioning a watercraft with respect to a support module in a watercraft storage assembly, the watercraft including a bottom and a width, the cradle assembly comprising a plurality of horizontally adjustable cradle beams, each cradle beam including a left and a right side;

a cradle wall vertically extending upward from each side of the cradle beam;

first and second transportation tracks traversing the cradle beams substantially parallel to the cradle walls; and a transportation rail positioned on each transportation track to engage the bottom of the watercraft as the cradle assembly moves the watercraft with respect to the support module.

13. The cradle assembly of claim 12, each cradle beam including a middle section, wherein the left and right sides horizontally extend with respect to the middle section.

14. The cradle assembly of claim 12, further including a cradle beam adjustment system positioned to control the horizontal adjustment of the cradle beams, wherein the cradle beam adjustment system selectively spaces the transportation tracks from each other a width less than the width of the watercraft.

15. The cradle assembly of claim 12, wherein the transportation rails are slidably positioned on the transportation tracks to horizontally vary the watercraft with respect to the cradle beams and the support module.

16. The cradle assembly of claim 15, further including a positioning system operatively connected to the transportation rails to extend a substantial portion of the transportation rails within the support module.

17. The cradle assembly of claim 12, further including a cradle clamp positioned on the cradle wall to selective engage the support module during movement of the watercraft relative to the support module.

18. The cradle assembly of claim 17, the cradle clamp further a bottom brace pivotally attached to the cradle assembly and positioned proximate to one of the cradle beams;

a top brace positioned on the cradle wall opposite the cradle beam; and the bottom brace including an actuating arm responsive to movement of the transportation rail to engage the bottom brace to the support module.

19. The cradle assembly of claim 18, wherein each brace includes a friction reducing device positioned to engage the support module and allow vertical movement of the cradle assembly relative to the support module.

20. A cradle assembly for use in a watercraft storage system including a support wall, at least two watercraft support modules mounted and stacked in relationship to said support wall, the watercraft including a bottom and a width, the cradle assembly comprising:

a plurality of horizontally adjustable cradle beams, each cradle beam including a left and a right side;

a cradle wall vertically extending upward from each side of the cradle beam;

first and second transportation tracks traversing the cradle beams substantially parallel to the cradle walls;

a transportation rail slidably positioned on each transportation track to engage the bottom of the watercraft as the cradle assembly moves the watercraft with respect to the support module;

a positioning system operatively connected to the transportation rail to extend a substantial portion of the transportation rail within the support module;

a cradle beam adjustment system positioned to control the horizontal adjustment of the cradle beams and selectively horizontally space the transportation tracks relative to each other;

a cradle clamp positioned on each cradle wall to selectively engage the support module during movement of the watercraft relative to the support module and restrict horizontal movement of the cradle assembly relative to the support module when engaged.

* * * * *